United States Patent [19]

Herrington

[11] Patent Number: 4,759,246

[45] Date of Patent: Jul. 26, 1988

[54] TUMBLING HOLE PUNCH AND METHOD FOR PUNCHING HOLES INTO A MOVING WEB MATERIAL

[75] Inventor: Fox J. Herrington, Holcomb, N.Y.

[73] Assignee: Mobil Oil Corporation, New York, N.Y.

[21] Appl. No.: 33,386

[22] Filed: Apr. 2, 1987

Related U.S. Application Data

[63] Continuation-in-part of Ser. No. 871,334, Jun. 6, 1986, Pat. No. 4,693,152.

[51] Int. Cl.[4] ..... B26F 1/08

[52] U.S. Cl. ..... 83/37; 83/337; 83/345

[58] Field of Search ..... 83/37, 18, 100, 337, 83/345, 327, 670

[56] References Cited

U.S. PATENT DOCUMENTS

| | | | |
|---|---|---|---|
| 2,760,576 | 8/1956 | Spencer | 83/337 X |
| 2,946,380 | 7/1960 | Scribner | 83/337 X |
| 3,147,656 | 9/1964 | Kwitek | 83/116 |
| 3,290,202 | 12/1966 | Pratt | 83/337 X |
| 3,483,780 | 12/1969 | Hudson | 83/81 |
| 3,550,494 | 5/1969 | Adams et al. | 83/99 |
| 3,680,419 | 8/1972 | Stoop | 83/98 |
| 3,728,918 | 4/1973 | Helm | 83/22 |
| 3,747,447 | 7/1973 | Wisner | 83/337 X |
| 4,218,944 | 8/1980 | Sclippa | 83/345 |
| 4,452,114 | 6/1984 | Rynik | 83/100 |
| 4,480,516 | 11/1984 | Leroy | 83/98 |

*Primary Examiner*—Frank T. Yost

*Attorney, Agent, or Firm*—Alexander J. McKillop; Michael G. Gilman; Charles J. Speciale

[57] ABSTRACT

A tumbling hole punch consists of a serrated tube plunging straight through a film web into a hole in a backup roll. The serrated punch is mounted to an arm which is geared to the backup roll so that the punch remains in register with the hole in the roll. In order to keep the axis of the serrated punch aligned with the axis of the hole in the roll, the punch pivots relative to its arm, and the pivoting is controlled by a gear belt drive so that as the arm rotates the punch tumbles in the opposite direction, keeping its axis parallel with the hole axis.

3 Claims, 4 Drawing Sheets

TUMBLING HOLE PUNCH AND METHOD FOR PUNCHING HOLES INTO A MOVING WEB MATERIAL

The present invention is a continuation-in-part of copending application Ser. No. 871,334, filed June, 6, 1986, for "Rotary Tube Punching Arrangement With Tumbling Punch and Method for Punching Holes in a Film Web", now U.S. Pat. No 4,693,152, of which I am a joint inventor.

RELATED APPLICATIONS

The present invention is an improvement on my prior invention disclosed in copending application Ser. No. 798,518 filed Nov. 15, 1985 for ROTARY TUBE PUNCHING ARRANGEMENT AND METHOD FOR PUNCHING HOLES INTO A MOVING WEB MATERIAL, now U.S. Pat. No. 4,656,900.

BACKGROUND OF THE INVENTION

The present invention relates to a system of accurately punching holes in a fast-moving web of thermoplastic film material, and more particularly, punching holes into the web at predetermined locations through the use of a tumbling hole tube punch which plunges straight through the film into a hole in a backup roll.

In the production of various types of articles which are basically formed from a thermoplastic film material, such as polyethylene film or the like; for instance, articles such as plastic bags employed in supermarkets or plastic garbage disposal or trash bags, it is frequently necessary to provide holes in a web of the thermoplastic film material employed for the high-speed series production of the bags, which must be punched through at a high degree of accuracy with respect to the location of the holes in the film web and repetitions in successive hole patterns. Thus, for instance, with regard to plastic bags onto which tapes are to be applied, and which are used for closing trash bags in the manner of a draw string, and into which there must be provided holes in order to afford a consumer access to the tape for closing the bags, the inability of presently employed production equipment in providing accurately positioned and dimensioned holes necessitates wider border edges to be formed in the film web for the receipt of such tapes, with the result of requiring greater amounts of plastic material in the formation of the bags thereby rendering current manufacturing methods less than optionally economical.

The apparatus and method disclosed in my aforesaid related application Ser. No. 798,518, incorporated herein by reference thereto, has overcome the foregoing problems to a substantial degree however it has left something to be desired. In my aforesaid related patent application there is described a serrated punch attached rigidly to an arm, with the arm geared to a backup roll so that the punch remains in register with the hole in the roll. Where the punch is rigidly attached to the arm, the punch enters the roll in the backup roll at an angle, so that the hole in the film is jagged in shape because of the teeth on the serrated punch. Also, the punch cuts through one edge of the hole first, allowing the chip to fall into the hole in the roll so that the film is not fully backed up during the entire punching operation. For best operation with a serrated punch, the punch should enter straight through the film so that it does not attempt to drag the film sideways. The present invention provides for the cutting teeth of the punch to enter through the film simultaneously so that the punch does enter straight.

It is an object of the present invention to provide a method and apparatus for punching a hole in a fast-moving web of film at predetermined repeat lengths at film speeds in the order of 300 ft/min. and when the diameter of the hole is as large as 2 inches in diameter.

SUMMARY OF THE INVENTION

In accordance with the present invention there is provided apparatus for punching holes in a moving web of film at a predetermined repeat lengths. The apparatus includes a rotatable anvil roll mounted on one side of the web and having an annular hole into which a punch enters. The punch comprises a rotary annular punch having a plurality of cutting teeth adapted to pierce the web and to enter the annular hole in the anvil roll at predetermined intervals. An arm is mounted for rotation about an axis at one end thereof on the opposite end of the arm and the circumference of the anvil roll is equal to the predetermined repeat length or an integral fraction or multiple thereof. A stationary pulley is mounted on the axis at the one end of the arm and a rotating pulley is attached to the punch on the opposite end of the arm, the ratio of the diameters of the pulleys being related to the number of anvil roll revolutions per repeat length. Means is provided for concurrently rotating the arm and the anvil roll in opposite directions and for rotating the punch in the same direction as the anvil roll whereby the punched teeth concurrently enter straight through the web to punch the hole.

Further in accordance with the present invention there is provided a tumbling hole punch comprising a serrated tube for plunging through the film into a hole in a backup roll. The serrated punch is mounted to an arm which is geared to the backup roll so that the punch remains in register with the hole in the roll. In order to keep the axis of the serrated punch aligned with the axis of the hole in the roll, the punch pivots relative to its arm, and the pivoting is controlled by a gear belt drive so that as the arm rotates the punch tumbles in the opposite direction, keeping its axis parallel with the hole axis.

Further in accordance with the invention there is provided a method for punching holes in a fast-moving web of film at a predetermined repeat length. The method comprises the steps of advancing the film web over a rotatable anvil with the film web extending in surface contact with at least a portion of the the circumference of the roll and at least one punch receiving annular hole of predetermined size extending through the circumferential surface of the anvil roll so as to communicate with the interior of the roll, the circumference of the anvil roll being equal to the predetermined repeat length or an integral fraction or multiple thereof, mounting an arm for rotation about one end thereof on the opposite side of the film web from the anvil roll, rotatably mounting an annular punch to the opposite end of the anvil arm and gearing the one end of the arm to the anvil roll so that the punch remains in register with the hole in the anvil roll on the opposite side of the film web, the one end of the arm being mounted on the axis of a stationary pulley and a rotating pulley being attached to the punch on the on the opposite end of the arm, and the ratio of the diameters of the pulleys being related to the number of anvil roll revolutions per repeat length, concurrently rotating the arm and the anvil roll in opposite directions and rotating the punch in the same direction as the anvil roll thereby causing the annular punch to pierce straight through the film web and to enter the annular hole in the anvil roll at predetermined intervals to punch the holes in the film web.

BRIEF DESCRIPTION OF THE DRAWINGS

Reference may now be had to the following detailed description of an exemplary embodiment of the tumbling hole punching system, taken in conjunction with the accompanying drawings in which.

Figure 3:
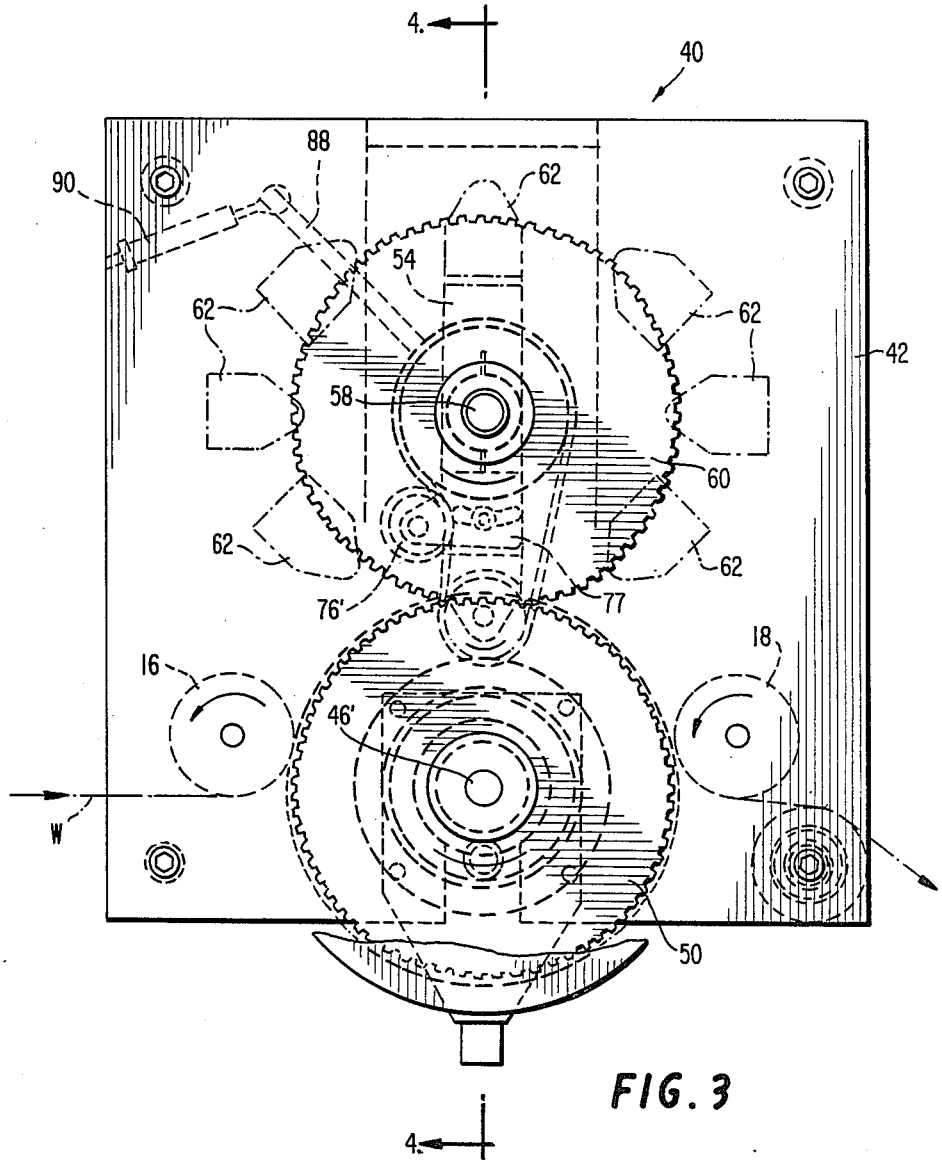
Figure 4:
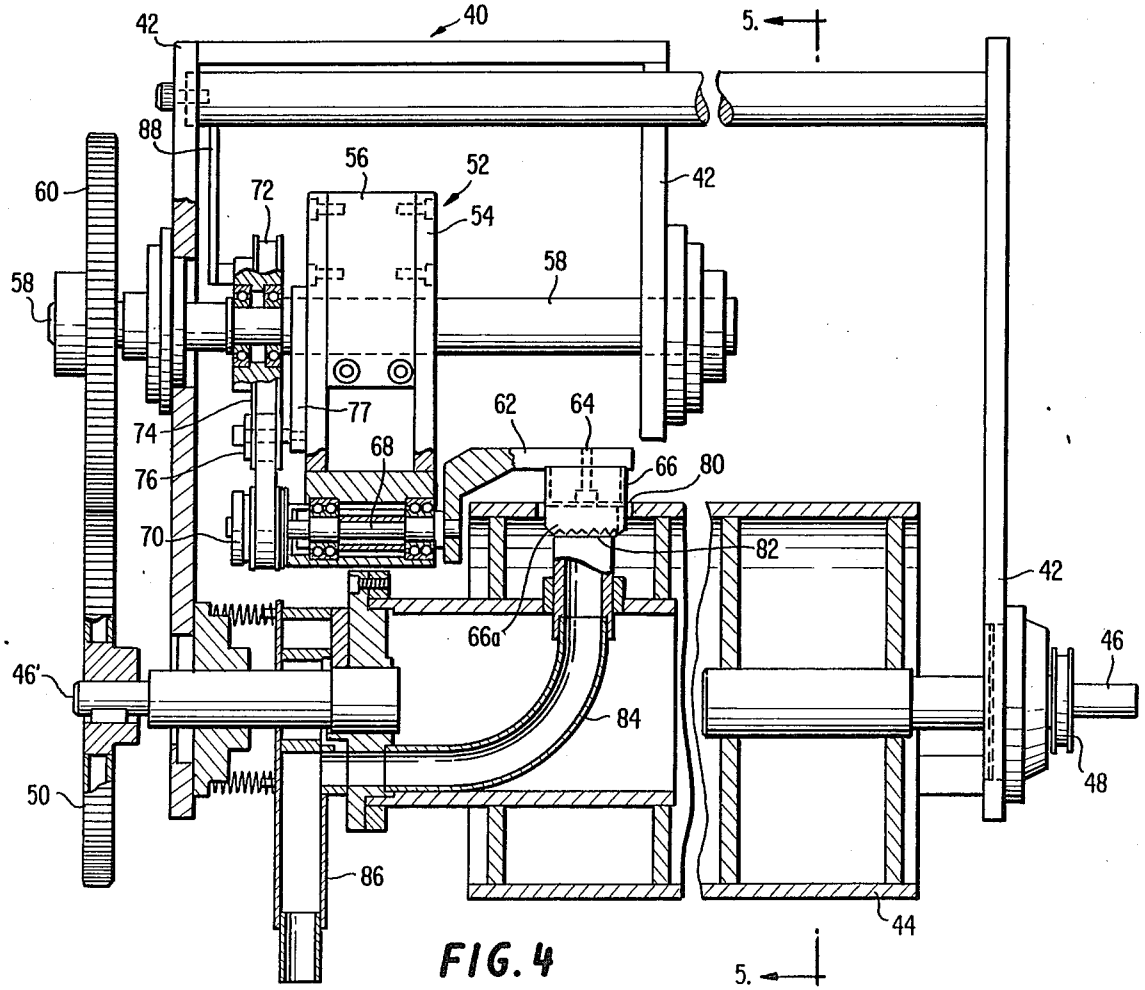
Figure 5:
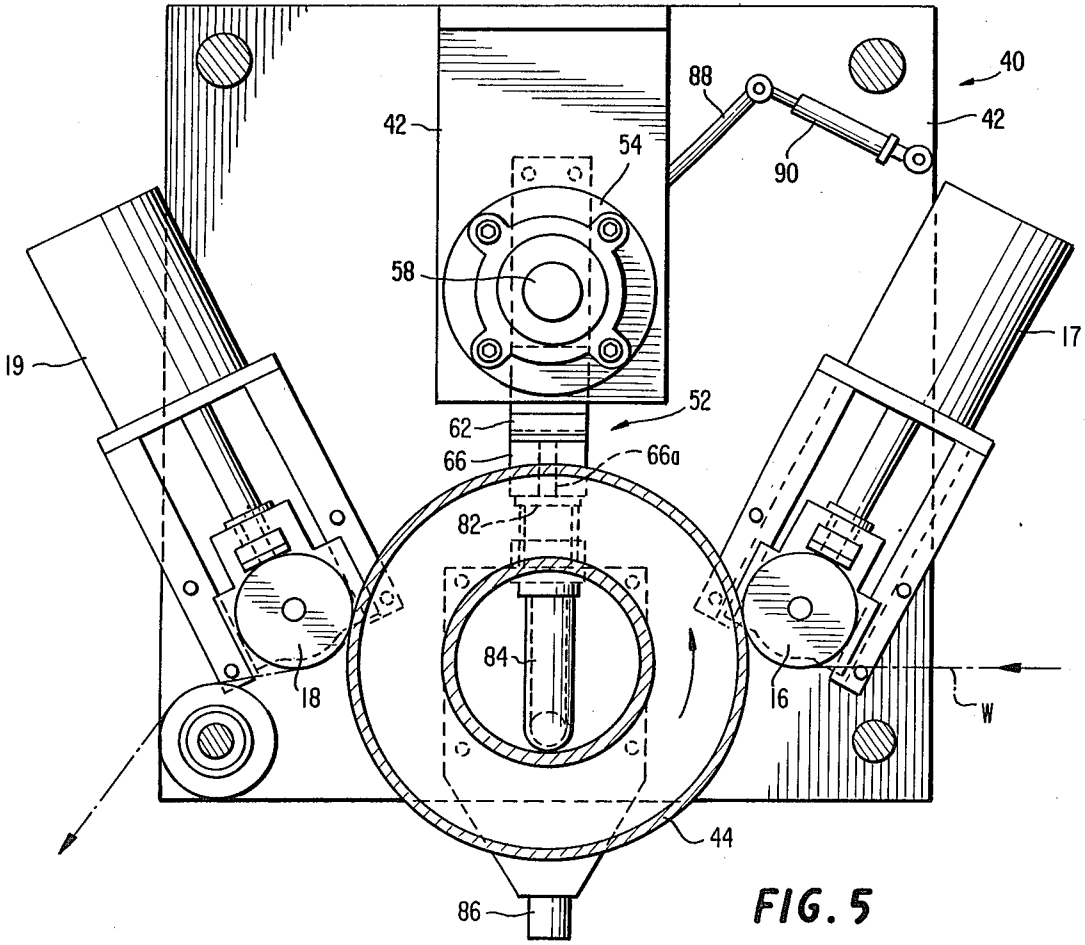

FIGS. *2a–2f* are schematic representations useful in explaining the operation of the present invention;

FIG. 3 is a front elevational view of an apparatus for punching holes in a continuously advancing web of a thermoplastic film material in accordance with the present invention;

FIG. 4 is a sectional view, taken along the lines 4—4 in FIG. 3; and FIG. 5 is a sectional view taken along the lines 5—5 in FIG. 4.

DETAILED DESCRIPTION OF THE PREFERRED EMBODIMENT

Figure 1:
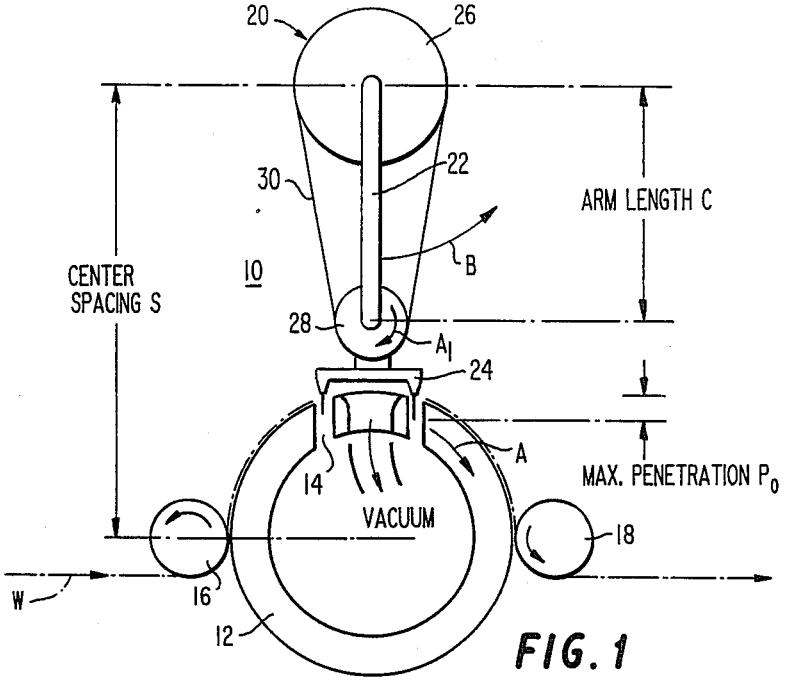
FIG. 1 illustrates a schematic representation of a system for punching holes in a continuously advancing web of a thermoplastic film material in accordance with the present invention.
Figure 2A:
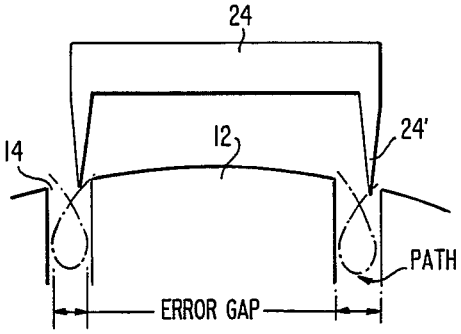
Figure 2B:
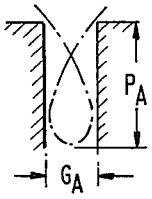
Figure 2C:
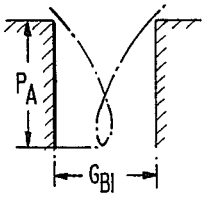
Figure 2D:
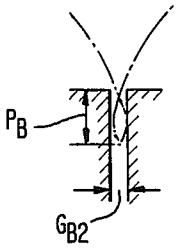
Figure 2E:
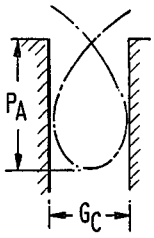
Figure 2F:
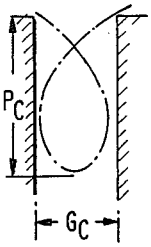

Referring to FIG. 1 of the drawings, there is schematically illustrated a tumbling hole punching system 10 for punching holes at predetermined repeat lengths into a continuously advancing web W of a thermoplastic film material, for example, such as polyethylene film which is utilized in the production of plastic bags, trash disposal bags or the like. The tumbling hole punching system 10 basically includes a backup roll in the form of an anvil roll 12, which is preferably, but not necessarily, of a hollow drum-like construction, and which has a punch-receiving annular opening 14 formed in its circumferential surface. A pair of freely-rotatable tension rollers 16 and 18 are positioned on opposite sides of the anvil roll 12, preferably in surface contact therewith, along which there is conducted the film web W such that the rollers 16 and 18 form tension guides for the web W as the web is being conducted over the circumferential surface of the anvil roll 12, to maintain the film web thereon in a predetermined tensioned condition. Associated with the anvil roll 12 and on the opposite side of the film web W is a tumbling die punch arrangement 20. The rotary die punching arrangement 20 includes an arm 22 mounted for rotation about one end thereof and having an annular punch 24 rotatably mounted to the opposite end of the arm and geared to the anvil roll 12, as shown in connection with FIGS. 3–5, so that the punch remains in register with the hole 14 in the anvil roll 12. There is a stationary gear belt pulley 26 located at the axis of the punch arm 22 and there is a rotating pulley 28 attached to the punch 24 which establishes the angular orientation of the punch. A gear belt 30, connecting the pulleys 26 and 28, causes the punch 24 to pivot relative to the arm 22 in a prescribed way. The anvil roll 12 is rotated through a suitable drive in the direction of arrow A while concurrently therewith the arm 22 rotates in the opposite direction, as indicated by arrow B, and the punch 24 rotates in the same direction as the anvil roll 12 as indicated by arrow A.

If the pulleys 26 and 28 are identical in size, the axis of the punch 24 will remain the same relative to the world at all times, and the punch 24 moves like a chair of a ferris wheel. If the stationary pulley 26 is a multiple of the diameter of the pulley 28 at the punch 24, then the punch 24 will tumble backward relative to the rotation of the arm 22. For example, if the stationary pulley 26 is 3 times the diameter of the punch pulley 28, then a 10° counter clockwise rotation of the arm 22 will result in a clockwise rotation of the punch 24 of 30° relative to the arm 22, which is a 20° absolute clockwise rotation. Therefore when the arm 22 moves through a full revolution, the punch tumbles backward twice. If the anvil roll 12 has a circumference of ½ the repeat length of the punch 24, then the punch arm 22 will make one revolution for each two revolutions of the anvil roll 12. The punch arm 22 rotates one-half the speed of the anvil roll 12 so that the punch 24 enters the anvil roll 12 once for every two revolutions of the anvil roll. Thus, when the anvil roll 12 rotates clockwise 20°, the punch arm 22 rotates counter clockwise 10°, and the punch 24 rotates clockwise 20°, which keeps its axis parallel to the axis of the annular hole 14 in the anvil 12. By proper selection of the center spacing of the punch arm 22 to the anvil roll 12, it is possible to have the punch 24 move in and out of the hole 14 with relatively small position error.

Ideally the punch 24 should move along a path straight radially relative to the anvil roll 12, so that the annular slot 14 can be made just slightly wider than the thickness of the punch teeth 24'. However, in practice there is an error in the path. The illustration in FIG. *2a* shows how the punch 24 moves relative to the anvil roll 12. Because of this path error, it is necessary to make the gap wide enough to accommodate the punch throughout its travel. The narrower this gap, the better the punch will work because the film will be supported better, and less free to stretch around the punch teeth 24' instead of being cut off.

The path of the punch teeth 24' is determined by the following parameters:

C=arm length from its axis to the pivot about which the punch tumbles;

P0=maximum penetration of the punch into roll;

V=repeat multiple which is the number of rotations of the anvil roll for each repeat length;

S=center spacing between anvil roll and punch arm;

Z=repeat length.

The effect of arm length and penetration can be seen by reference to FIGS. *2b–2f*. It will be understood that the best condition is for a large penetration of the punch and a small gap in the anvil. In FIG. *2b*, it can be seen that the maximum penetration $P_A$ is optimum, since it takes advantage of errors in both directions, and fits within the gap $G_A$. If the arm 22 is made shorter, then the path changes to that shown in FIGS. *2c* and *2d*. If the penetration remains at $P_A$, FIG. *2c*, the required gap increases to $G_{B1}$ to accommodate the path error at the top. If the penetration is reduced to $P_B$, FIG. *2d*, then the gap can be reduced to $G_{B2}$, which is optimum for this penetration. Conversely, if the arm 22 is made longer, the path will change to that shown in FIGS. *2e* and *2f*. The gap increases to $G_c$, which permits the penetration to increase to $P_c$. From the foregoing it can be seen that for a given penetration there is an optimum arm length and required gap and the greater penetration requires a larger gap.

The foregoing geometry was analyzed by varying the parameters to the following levels:

V=Repeat multiple (1, 2, 3, 4)
S=Center spacing (6", 9", 12")
Z=Repeat length (24", 27", 30", 33)
P=Maximum penetration ($\frac{1}{2}$", $\frac{5}{8}$", $\frac{3}{4}$", $\frac{7}{8}$")

For each combination, the optimum arm length (C) was calculated, then using that arm length the path error was determined. Using the results of this study, the following equations (1) and (2) were developed by which arm length and path error can be calculated.

$$C = \frac{SV}{V+1} + \left[ .60 - .11 \frac{V+1}{V} \right] P_o \quad (1)$$

$$E = \frac{.372\, P_o\, 1.46\, (V + 1.9)^{.55}}{S^{.48}} \quad (2)$$

where
C=arm length
E=path error (gap must be equal to this plus tooth thickness plus clearance)
S=center spacing
V=repeat multiple
$P_o$=maximum penetration From the foregoing equations (1) and (2) it will be seen that arm length C and path error E are independent of repeat length Z. Thus it is possible to build a machine which works for all repeat lengths, with change-over for repeat lengths requiring only replacement of the anvil roll and the punch holder.

Referring to FIGS. 3–5 of the drawings, there is illustrated a preferred embodiment of a tumbling hole punching system 40 for punching holes at predetermined repeat lengths in a continuously advancing web W of thermoplastic film material. Rotatably supported between a pair of end plates of a stationary frame structure 42 is a hollow anvil roll 44, which may be a closed-ended metal drum. Projecting coaxially from the opposite ends of the anvil roll 44 are stub shafts 46 and 46', FIG. 4, which are fixed thereto. The stub shafts 46 and 46' are rotatably journaled in suitable bearings provided in the stationary frame structure 42. The stub shaft 46 has mounted thereon a drive pulley 48 which is connected to a suitable driving arrangement (not shown) and the stub shaft 46' has mounted thereon a spur gear 50 for rotation therewith. A rotary die punching arrangement 52 consists of an arm member 54 which, at one end thereof, is fixed by a clamp 56 to a rotatable shaft 58 which is journaled in the frame structure 42, and which extends in parallel spaced relationship with the shaft 46, 46' for the anvil roll 44. A spur gear 60 fastened to one end of the tumble shaft 58 is in driving engagement with the spur gear 50 such that both shafts 46 and 58 may be counter-rotated in predetermined synchronism by a suitable driving arrangement connected with the drive pulley 48.

Rotatably mounted to the opposite end of the tumble arm 54 is a punch holder 62 to which is fastened by a screw 64 an annular or sleeve-like cutter 66 having a serrated or toothed cutting edge **66*a* facing toward the circumferential surface of the anvil roll 44. As may be seen in FIG. 4 the punch holder 62 is mounted on one end of a shaft 68 which is journaled in bearings mounted in the end of the arm 54 opposite its pivot on shaft 58. The opposite end of the punch shaft 68 has fixed thereto a pulley 70 which rotates with the punch shaft 68 and the punch holder 62. A stationary pulley 72 is mounted on tumble shaft 58 at the axis of the tumble arm 54. The pulleys 70 and 72 are interconnected by a gear belt 74 for concurrent rotation. An idler 76 carried by a take-up bracket 77** is provided to adjust the tension in the gear belt drive.

As may be seen in FIG. 4, the annular die or cutter 66 is received within an annular opening 80 between the surface of the anvil roll 44 an the anvil 82 which is positioned within the opening in the circumferential surface of the anvil roll 44. The anvil 82 is supported in fixed position at its lower end with respect to the interior of the anvil roll 44 and rotates with the anvil roll 44. The lower end of the anvil 82 is connected with a tube 84 which in turn is connected to a vacuum discharge tube 86 which is in communication with a suction device (not shown) for aspirating the punched-out portions of the film web W to a waste disposal.

As shown in FIGS. 3–5, there is provided a torque arm 88 which is connected to the pulley 72 to maintain the pulley 72 stationary with respect to the shaft 58. The other end of the torque arm 88 is provided with an adjustable link 90 having one end thereof secured to the frame 42 and the other end secured to the end of torque arm 88. The link 90 includes threaded members which adjust the overall length of the link 90 and provides for alignment of the punch 66 with the anvil hole 80 in the anvil roll 44.

It will be noted that the specific embodiment of the invention illustrated in FIGS. 3–5 corresponds with the embodiment schematically illustrated in FIG. 1. The film web W passes over a portion of the circumference of the surface of the anvil roll 44 and is held there against by the rubber rolls 16 and 18. The rolls 16 and 18 are biased against the surface of the anvil roll 44 by suitable means such as the air cylinders 17 and 19 shown in FIG. 5 to maintain tension on the web W. The relative rotational movement between the anvil roll 44 and the tumble shaft 58 is determined by the ratio of the pitch diameters of the interengaged gears 50 and 60. In the embodiment illustrated in FIGS. 3–5 the ratio is 1:1 and thus the tumble shaft 58 and the shaft 46, 46' for the anvil roll 44 rotate at the same speed but in opposite directions. Since the stationary pulley 72 is a multiple of the diameter of the pulley 70 for the punch holder 62 and the punch 66, the punch holder 62 and punch 66 will tumble backward relative to the rotation of the tumble arm 54. This is illustrated by the punch holder 62 shown in phantom lines in FIG. 3. By way of another example, if the stationary pulley 72 is 3 times the diameter of the punch pulley 70, when the tumble arm 54 moves through a full rotation, the punch 66 tumbles backward twice. If the anvil roll 44 has a circumference of $\frac{1}{2}$ the repeat length of the punch 66, then the punch arm 54 will make one revolution for each two revolutions of the anvil roll 44. In other words, the punch 66 will enter the annular opening 80 in the anvil roll 44 once during each two revolutions of the anvil roll 44.

In a specific example for producing bags from plastic film web W having a repeat length of 30", the anvil roll 44 has a circumferential length of 15". The cutting edge **66*a* of the cutter 66 is on the axis of the punch shaft 68 and has a radius of rotation of about $2\frac{1}{8}$" about the axis of the tumble shaft 58, such that the rotary punching device 52 makes one revolution forever two revolutions of the anvil roll 44. The cutter 66 is about 2" in diameter and the opening 80 in the anvil roll 44** is about 2 3/16"

in diameter, with the cutter 66 imbedding about $\frac{7}{8}''$ into the opening 80 when piercing through the film web W.

While there has been described a preferred embodiment of the invention, it will be understood that further modifications may be made without departing from the spirit and scope of the invention as set forth in the appended claims.

What is claimed is:

1. A method for punching holes in a fast-moving web of film at predetermined repeat lengths comprising advancing a film web over a rotatable backup roll with the film web extending in surface contact with at least a portion of the circumference of the roll and at least one punch receiving annular hole of predetermined size extending through the circumferential surface of the anvil roll so as to communicate with the interior of the roll, positioning a punch having a plurality of teeth for punching through the film into a hole into the backup roll, the punch being mounted in a holder to a rotatable arm which is geared to the backup roll so that the punch remains in register with the hole in the roll, and keeping the axis of the punch aligned with the axis of the hole in the roll by pivoting of the punch relative to its arm and controlling the pivoting of the punch so that as the arm rotates the punch tumbles in the opposite direction, keeping its axis parallel with the hole axis; wherein the path of movement of the punch teeth relative to the annular hole in the anvil roll is determined by the following parameters:

C=arm length from its axis to the pivot about which the punch tumbles, $P_o$=maximum penetration of the punch into the annular hole in the anvil roll, V=repeat multiple, which is the number of rotations of the anvil roll for each repeat.

S=center spacing between the anvil roll and the punch, and

Z=repeat length; and wherein said annular hole comprises an annular slot having a gap equal to the thickness of the punch teeth plus mechanical clearance and the path error E, where the arm length C and the path error E are calculated by the following equations:

$$C = \frac{SV}{V+1} + \left[.60 - .11\frac{V+1}{V}\right]P_o$$

$$E = \frac{.372\,P_o^{1.46}\,(V+1.9)^{.55}}{S^{.48}}$$

whereby change over of the apparatus for all repeat lengths requires only replacement of the anvil roll and the punch holder independent of the repeat length.

2. A method for punching holes in a fast-moving web of film at predetermined repeat lengths comprising advancing the film web over a rotatable anvil roll with the film web extending in surface contact with at least a portion of the circumference of the roll and at least one punch receiving annular hole of predetermined size extending through the circumferential surface of the anvil roll so as to communicate with the interior of the roll, the circumference of the anvil roll being equal to the predetermined repeat length or an integral fraction or multiple thereof, mounting an arm for rotation about one end thereof on the opposite side of the film web from the anvil roll, rotatably mounting an annular punch having a plurality of teeth in a holder to the opposite end of the arm and gearing the one end of the arm to the anvil roll so that the punch remains in register with the hole in the anvil roll on the opposite side of the film web, the one end of the arm being mounted on the axis of a stationary pulley and a rotating pulley being attached to the punch on the opposite end of the arm, and the ration of the diameters of the pulleys being related to the number of anvil roll revolutions per repeat length, concurrently rotating the arm and the anvil roll in opposite directions and rotating the punch in the same direction as the anvil roll thereby causing the annular punch teeth to pierce straight through the film web an to enter the annular hole in the anvil roll at predetermined intervals to punch said holes in said film web; wherein the path of movement of the punch teeth relative to the annular hole in the anvil roll is determined by the following parameters:

C=arm length from its axis to the pivot about which the punch tumbles, un $P_o$=maximum penetration of the punch into the annular hole in the anvil roll, V=repeat multiple, which is the number of rotations of the anvil roll for each repeat, S=center spacing between the anvil roll and the punch, and Z=repeat length, and wherein said annular hole comprises an annular slot having a gap equal to the thickness of the punch teeth plus mechanical clearance and the path error E, where the arm length C and the path error E are calculated by the following equations:

$$C = \frac{SV}{V+1} + \left[.60 - .11\frac{V+1}{V}\right]P_o$$

$$E = \frac{.372\,P_o^{1.46}\,(V+1.9)^{.55}}{S^{.48}}$$

whereby change over of the apparatus for all repeat lengths requires only replacement of the anvil roll and the punch holder independent of the repeat length.

3. Apparatus for punching holes in moving web of film at predetermined repeat lengths comprising a rotatable anvil roll mounted on one side of the film web and having an annular hole into which a punch enters, a rotary annnular punch having a plurality of cutting teeth adapted to pierce the film web and to enter said annular hole in said anvil roll at predetermined intervals, an arm mounted for rotation abut an axis at one end thereof on the opposite side of the film web from said anvil roll and geared to said anvil roll, said rotary punch being pivotally mounted in a holder to the opposite end of said arm, the circumference of said anvil roll being equal to the predetermined repeat length or an integral fraction or multiple thereof, a stationary pulley mounted on said axis at said one end of said arm, a rotating pulley attached to said punch on said opposite end of said arm, the ratio of the diameters of said pulleys being related to the number of anvil roll revolutions per repeat length, and means for concurrently rotating said arm and said anvil roll in opposite directions and for rotating said punch in the same direction as said anvil roll whereby said punch teeth concurrently enter straight through the film web to punch said holes;

wherein the path of movement of the punch teeth relative to the annular hole in the anvil roll is determined by the following parameters:

C=arm length from its axis to the pivot abut which the punch tumbles, $P_o$=maximum penetration of the punch into the annular hole the anvil roll, V=repeat multiple, which is the number of rotations of the anvil roll for each repeat, S=center spacing between the anvil roll and the punch, and Z=repeat length; and wherein said annular hole comprises an annular slot having a gap equal to the thickness of the punch teeth plus mechaincal clearance and the path error E, where the arm length C and the path error E are calculated by the following equations:

$$C = \frac{SV}{V+1} + \left[ .60 - .11 \frac{V+1}{V} \right] P_o$$

$$E = \frac{.372\, P_o^{1.46}\, (V + 1.9)^{.55}}{S^{.48}}$$

whereby change over of the apparatus for all repeat lengths requires only replacement of the anvil roll and the punch holer independent of the repeat length.

* * * * *